US009789885B2

(12) United States Patent
Stiles et al.

(10) Patent No.: US 9,789,885 B2
(45) Date of Patent: Oct. 17, 2017

(54) AUTO-RACK RAILCAR PANEL BUMPER GUARD AND SIDE POST GUARD APPARATUSES AND METHODS OF USING THE SAME

(71) Applicant: Holland LP, Crete, IL (US)

(72) Inventors: Alexander Stiles, Park Forest, IL (US); Erik Johnsen, Cedar Lake, IN (US)

(73) Assignee: Holland, L.P., Crete, IL (US)

( * ) Notice: Subject to any disclaimer, the term of this patent is extended or adjusted under 35 U.S.C. 154(b) by 171 days.

(21) Appl. No.: 14/687,575

(22) Filed: Apr. 15, 2015

(65) Prior Publication Data

US 2015/0291182 A1 Oct. 15, 2015

Related U.S. Application Data

(60) Provisional application No. 61/979,718, filed on Apr. 15, 2014.

(51) Int. Cl.
*B61D 3/18* (2006.01)
*B61D 45/00* (2006.01)

(52) U.S. Cl.
CPC ..... *B61D 45/008* (2013.01); *B61D 3/18* (2013.01)

(58) Field of Classification Search
CPC ..... B61D 3/187; B61D 3/18; B61D 45/008; B61D 45/00; B61D 17/08; B60R 13/04; B60R 13/0206; B60R 19/44; B60R 2019/026; E04F 19/026; B60P 3/08; B60P 7/16
See application file for complete search history.

(56) References Cited

U.S. PATENT DOCUMENTS

| | | | | |
|---|---|---|---|---|
| 3,861,110 | A * | 1/1975 | Bartlett | E04F 19/026 293/1 |
| 3,995,901 | A | 12/1976 | Filbert, Jr. et al. | |
| 5,239,933 | A | 8/1993 | Murphy et al. | |
| 6,561,740 | B1 | 5/2003 | Burke et al. | |
| 6,805,523 | B2 | 10/2004 | Burke et al. | |
| 7,071,410 | B1 * | 7/2006 | Kiely | F16L 57/00 174/135 |
| 2001/0041772 | A1 | 11/2001 | Masubuchi et al. | |

FOREIGN PATENT DOCUMENTS

| | | |
|---|---|---|
| DE | 10103548 A1 | 6/2001 |
| RU | 34476 U1 | 10/2003 |

OTHER PUBLICATIONS

International Search Report for PCT Pat. App. No. PCT/US2015/025979, dated Aug. 30, 2015.
Written Opinion of the International Searching Authority for PCT Pat. App. No. PCT/US2015/025979, dated Aug. 20, 2015.

* cited by examiner

*Primary Examiner* — Mark Le
(74) *Attorney, Agent, or Firm* — Scherrer Patent & Trademark Law, P.C.; Stephen T. Scherrer; Monique A. Morneault

(57) ABSTRACT

Bumper guard and side post guard apparatuses prevent vehicles from being damaged when stored and transported within an auto-rack railcar, such as when vehicle doors are opened, where vehicle doors may otherwise contact the side panels and side posts of the auto-rack railcar. Methods of using the same are further provided.

20 Claims, 8 Drawing Sheets

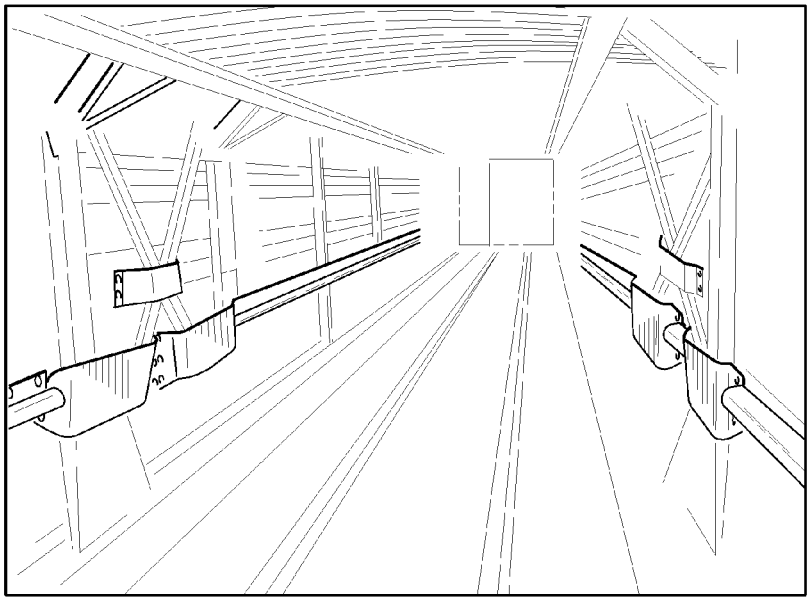
FIG. 1
—PRIOR ART—
FIG. 2
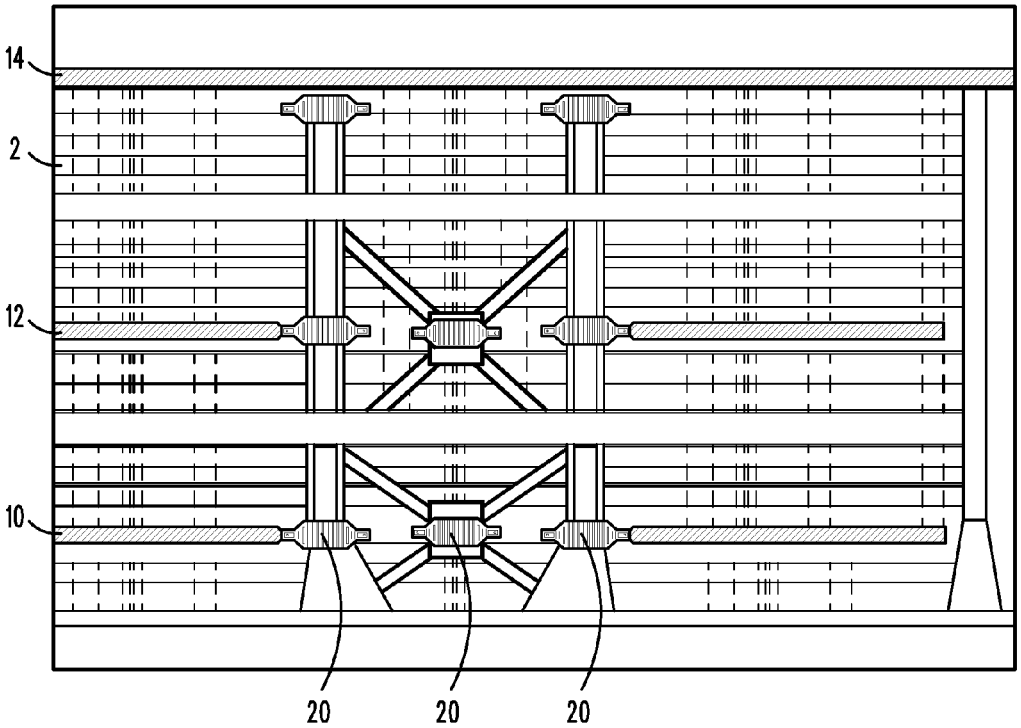

AUTO-RACK RAILCAR PANEL BUMPER GUARD AND SIDE POST GUARD APPARATUSES AND METHODS OF USING THE SAME

The present invention claims priority to U.S. Provisional Pat. App. No. 61/979,718, titled "Auto-Rack Railcar Panel Bumper Guard and Side Post Guard Apparatuses and Methods of Using the Same", filed Apr. 15, 2014, which is incorporated herein by reference in its entirety.

TECHNICAL FIELD

The present invention relates to bumper guard and side post guard apparatuses for use with an auto-rack railcar side panel. The bumper guard and side post guard apparatuses prevent vehicles from being damaged when stored and transported within an auto-rack railcar, such as when vehicle doors are opened, where vehicle doors may otherwise contact the side panels and/or side posts of the auto-rack railcar. Methods of using the same are further provided.

BACKGROUND

Auto-rack railroad cars have been utilized for many years to transport automobiles, light trucks, and other like vehicles over great distances via the railroads. Specifically, the auto-rack railroad car generally is compartmentalized, having at least one level, but in many cases two or three levels, where automobiles may be parked for transport of the same. Typically, to protect the automobiles transported therein, auto-rack railroad cars typically have perforated metal side panels and a roof thereover. Doors for loading and unloading of vehicles are typically found on opposite ends thereof. The levels on which the vehicles sit are typically decks containing a means for securing the vehicles to the decks. An example of a deck for this purpose is a metal floor grating system, and the vehicles' wheels typically rest on the decks, as illustrated in FIG. 1.

Oftentimes, the auto-rack railroad cars provide a relatively small space to hold and transport vehicles. In many cases, vehicles may be placed relatively close to the mesh or perforated side panels and side posts of the railcars. Typically, these side panels and side posts may be made of metal or other like hard structural material. After vehicles are driven into the auto-rack railroad cars, the driver must open the vehicle. Moreover, vehicle doors are opened when drivers must remove the vehicles from the auto-rack railroad cars after transporting the same. However when the doors of the vehicles are opened while inside an auto-rack railroad car, there is a high risk that the doors will contact the metal side panels and/or side posts causing scratches, gouges, dents, or other like damage to the vehicle doors. In many cases, brand new vehicles are transported using auto-rack railroad cars, and damage to the doors caused in this manner typically require repairing of the damage, causing delays. Therefore, a need exists for preventing damage to vehicles transported using auto-rack railroad cars.

Several solutions have been attempted to protect vehicle doors from damage when storing and/or transporting in auto-rack railroad cars. These solutions have included straps, rubber hoses, adhesive tape, spray on foam, and other like elements that are placed on or adjacent the side panels and/or side posts in an attempt to prevent the doors from contacting the side panels. These solutions typically do not provide adequate protection and in many cases the doors may still come into contact with the side panels and/or side posts causing damage to the doors. A need, therefore, exists for improved protection against damage to vehicle doors that may be caused by the contact of the vehicle doors with the side panels and/or side posts of an auto-rack railroad car.

Another solution has been to mount a plastic or rubber, preformed bumper guard onto the side panels and/or side posts of the auto-rack railroad cars to present an alternate contacting surface for the vehicle doors that will not damage the vehicle doors if contacting the same. Prior art bumper guards are shown in FIG. 1. These bumper guards have been used extensively in the industry, but the bumper guards currently in use still suffer from several problems.

It is often difficult to utilize prior art bumper guards universally on side panels of auto-rack railroad cars. Auto-rack railroad cars are not standardized, and the side panels may be made of a mesh or perforated metal sheet. Thus, side panels may come in several types, with varying mesh patterns, perforations or the like, that may make it difficult to mount the bumper guards thereto. A need, therefore, exists for improved bumper guard apparatuses and methods of using the same that may be utilized in a plurality of different side panel types. More specifically, a need exists for improved bumper guard apparatuses and methods of using the same having mounting bases having mounting holes that easily align with mesh or perforations of side panels of auto-rack railroad cars.

Moreover, side panels further are typically not merely metal sheets covering the sides of the auto-rack railroad cars, but may further consist of several frame pieces that together form the side panels, and these elements may not include apertures or holes that may be used to mount something thereto. For example, side panels may include metal members that may form L-shaped flanges that may extend from the side panel, forming spaces between adjacent members. These L-shaped flanges may not include apertures or holes for mounting bumper guards thereto. A need exists, therefore, for bumper guards that may be mountable in locations without apertures or holes for mounting the same thereon.

Moreover, bumper guards are typically required to be placed on side panels in strategic locations to present a contact surface for the vehicle doors if opened. Vehicles are manufactured in many shapes and sizes, and vehicle door size and placement may be different from vehicle to vehicle. Because of this, vehicle doors may not open uniformly, and may potentially contact side panels of auto-rack railroad cars in different locations. Therefore, a need exists for bumper guard apparatuses for auto-rack railroad cars that may be easily placed and mounted in different locations on side panels and/or side posts thereof. Further, a need exists for bumper guard apparatuses for auto-rack railroad cars that may quickly and easily be removed and replaced when necessary.

In addition, typical bumper guard apparatuses may be relatively thin and may not provide adequate protection, especially when utilized in extreme temperatures, such as extreme heat and/or extreme cold. A need exists for bumper guard apparatuses that may easily withstand the elements and extreme temperature changes. For example, bumper guards are typically required to withstand a temperature range of between −40° F. and 130° F.

SUMMARY OF THE INVENTION

The present invention relates to bumper guard and/or side post guard apparatuses for use with an auto-rack railcar side panel. The bumper guard apparatuses prevent vehicles from being damaged when stored and transported within an auto-rack railcar, such as when vehicle doors are opened, where vehicle doors may otherwise contact the side panels and/or side posts of the auto-rack railcar. Specifically, bumper guard apparatuses of the present invention may be utilized on perforated metal walls of auto-rack railcars, such as on A-deck, B-deck, as well as on C-deck. Moreover, side post guards of the present invention may be utilized on side posts, cross-members, or other structural features of side walls and/or frames. Methods of using the same are further provided.

To this end, in an embodiment of the present invention, a railcar sidewall bumper apparatus is provided. The railcar sidewall bumper apparatus comprises: an elongated length having an attachment flange portion and a rounded bumper portion, wherein the attachment flange portion extends from a first side to a second side of the elongated length and further has an top edge and a bottom transition portion, wherein the bottom transition portion transitions between the attachment flange and the rounded bumper portion, and further wherein the rounded bumper portion extends from the first side to the second side and, in cross-section, has an elliptical C-shape comprising a first leg, an outer curve and a second leg, and further wherein the first leg extends from the bottom transition portion of the attachment flange portion and further wherein the second leg comprises a curved bottom edge.

In an embodiment, the railcar sidewall bumper apparatus further comprises: a plurality of apertures in the attachment flange portion for attaching the railcar sidewall bumper to a railcar sidewall.

In an embodiment, the railcar sidewall bumper apparatus further comprises: a raised portion around each of the plurality of apertures.

In an embodiment, the plurality of apertures are oval slots.

In an embodiment, the railcar sidewall bumper apparatus is made from a material having a consistent thickness at all points in the sidewall bumper apparatus.

In an embodiment, the bottom transition portion of the attachment flange portion is curved.

In an embodiment, the first leg and the second leg are curved.

In an embodiment, the top edge of the attachment flange portion has a clip element.

In an embodiment, the clip element comprises a nub running from the first side to the second side of the railcar sidewall bumper apparatus.

In an embodiment, the attachment flange portion extends upwardly from the first leg at roughly a ninety degree angle.

In an embodiment, the attachment flange portion extends upwardly from the first leg at less than a ninety degree angle.

In an alternate embodiment of the present invention, a railcar sidewall post guard apparatus is provided. The railcar sidewall post guard apparatus comprises: a main body portion, and first and second wings extending from first and second sides of the main body portion, the main body portion having a plurality of undulations therein, each undulation having a peak portion and a trough portion.

In an embodiment, the plurality of undulations near the first and second wings are larger than the plurality of undulations near the center of the main body portion.

In an embodiment, the plurality of undulations are the same size.

In an embodiment, the railcar sidewall post guard apparatus further comprises: a first aperture in the first wing and a second aperture in the second wing.

In an embodiment, the railcar sidewall post guard apparatus further comprises: a first raised portion around the first aperture and a second raised portion around the second aperture.

In an embodiment, the first and second raised portions extend from the first and second wings, respectively onto adjacent undulations on the main body portion.

In an embodiment, the main body portion comprises first and second angled edges extending from the first wing and first and second angled edges extending from the second wing.

In an embodiment, the railcar sidewall post guard apparatus further comprises: a plurality of ribs disposed within at least one trough portion of the main body.

In an embodiment, the railcar sidewall post guard apparatus is made from a material selected from the group consisting of a thermoplastic polymer and a thermoset polymer.

It is, therefore, an advantage and objective of the present invention to prevent damage to vehicles transported using auto-rack railroad cars.

Moreover, it is an advantage and objective of the present invention to provide improved protection against damage to vehicle doors that may be caused by the contact of the vehicle doors with the side panels and/or side posts of an auto-rack railroad car.

In addition, it is an advantage and objective of the present invention to provide improved bumper guard and side post guard apparatuses and methods of using the same that may be utilized in a plurality of different side panels, side post types, cross-beams and/or auto-rack railcar configurations.

More specifically, it is an advantage and objective of the present invention to provide improved bumper guard and/or side post guard apparatuses and methods of using the same having mounting bases having mounting holes that easily align with mesh or perforations of side panels of auto-rack railroad cars.

And, it is an advantage and objective of the present invention to provide improved bumper guard and/or side post guard apparatuses that may be mountable in locations without apertures or holes for mounting the same thereon.

Further, it is an advantage and objective of the present invention to provide bumper guard and/or side post guard apparatuses for auto-rack railroad cars that may be easily placed and mounted in different locations on side panels thereof.

Still further, it is an advantage and objective of the present invention to provide bumper guard and/or side post guard apparatuses for auto-rack railroad cars that may quickly be removed and relocated based on the type and contact placement of doors of vehicles contained therein.

In addition, it is an advantage and objective of the present invention to provide improved bumper guard and/or side post guard apparatuses that may easily withstand the elements and extreme temperature changes.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIG. 1 illustrates prior art of auto-rack railcars.

FIG. 2 illustrates a sidewall of an auto-rack railcar having bumper guards and side post guards in an embodiment of the present invention.

DETAILED DESCRIPTION OF THE PRESENTLY PREFERRED EMBODIMENTS

Figure 3:
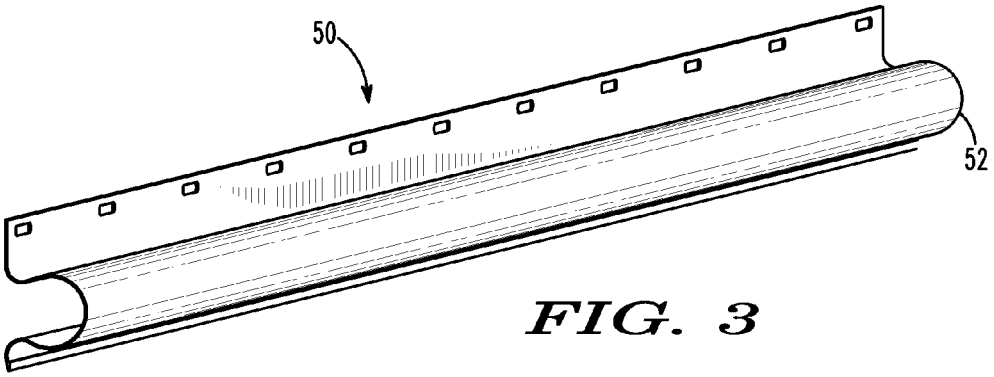
FIG. 3 illustrates a perspective view of a bumper guard in an embodiment of the present invention.

The present invention relates to bumper guard and/or side post guard apparatuses for use with an auto-rack railcar side panel. The bumper guard and/or side post guard apparatuses prevent vehicles from being damaged when stored and transported within an auto-rack railcar, such as when vehicle doors are opened, where vehicle doors may otherwise contact the side panels and/or side posts of the auto-rack railcar. Methods of using the same are further provided.

Now referring to the figures, wherein like numerals refer to like parts, FIG. 1 illustrates a prior art view of a typical auto-rack railcar, where automobiles may be stored for transport thereof via railroad. Specifically, automobiles may be loaded onto one of a plurality of levels for storage and transport. As noted above, oftentimes, door panels of the automobiles may become damaged when the doors are opened and contact the metal side walls of the auto-rack railcars.

FIG. 2 illustrates a side wall 2 of an internal compartment of an auto-rack railcar having three decks, typically denoted as A, B and C decks. A deck is typically the lowest deck; B deck is typically the middle deck; and C deck is typically the uppermost deck. As illustrated the side wall 2 may comprise a plurality of bumper guards 10, 12, 14 that may be disposed on the auto-rack railcar sidewall 2 to prevent damage to automobiles, such as when automobile doors are opened when stored therein. As illustrated, one or more bumper guards 10 may be attached to the side wall 2 on A deck, one or more bumper guards 12 may be attached to the side wall 2 on B deck, and one or more bumper guards 14 may be attached to the side wall 2 on C deck. Moreover, a plurality of side post guards 20 may be disposed on the side wall 2 of the auto-rack railcar, as described in more detail below with reference to FIGS. 13-15.

FIG. 3 illustrates a bumper guard 50 in an embodiment of the present invention. The bumper guard 50 may be attachable onto A, B and/or C deck via bolting, buttoning or clipping the same to the side wall, as disclosed herein. Specifically, the bumper guard 50 may be an elongated roughly C-shaped (in cross-section) piece that may be made of material that may be relatively soft so as to provide cushioning on car doors when contacting the same, and may offer a degree of resiliency and may depress, compress or otherwise give or slightly deform when contacted thereby. Preferably, the bumper guard 50 may be made from a thermoplastic material that may be extruded into shape via any method known to one of ordinary skill in the art. Moreover, because of the C-shaped profile of the bumper guard 50, the contacting surface 52 may be pressed toward the side wall of the auto-rack railcar, allowing slight deformation of the same, absorbing energy and protecting a car door. In a preferred embodiment, the C-shaped section of the bumper guard may be of a consistent thickness throughout, providing strength and resilience thereto.

Figure 4:
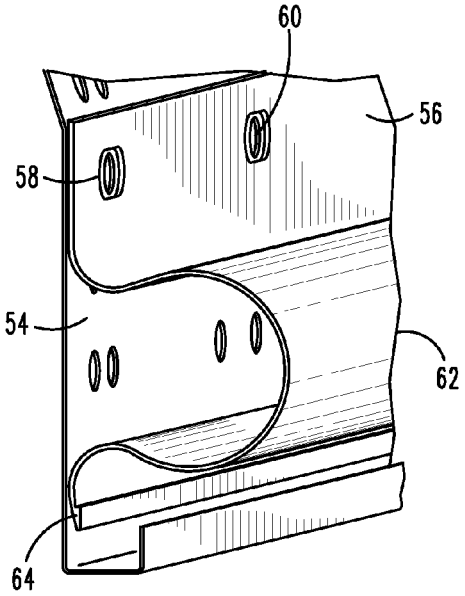
FIG. 4 illustrates a close-up perspective view of a bumper guard on a sidewall of an auto-rack railcar in an embodiment of the present invention.

FIG. 4 illustrates a close-up view of the bumper guard 50 illustrating how the bumper guard 50 may be attached to the side wall 54 of the auto-rack railcar. The bumper guard 50 may comprise a flat leg portion 56 that may be placed vertically on the side wall 54 having a plurality of holes or apertures 58 therein for aligning with one or more holes 60 contained in the side wall 54. A bolt, button, clip, or other like fastening means (not shown) may be disposed through one or more of the holes or apertures 58 of the bumper guard 50 and through the one or more holes 60 contained in the side wall 54, rigidly holding the bumper guard 50 in place on the side wall 54.

The bumper guard 50 may further have the previously described C-shaped section 62 having the contacting surface 52 on an outside thereof, extending outwardly from an end of the flat leg portion 56 forming the C-shape and terminating at a second clip leg portion 64. As illustrated in FIG. 4, the clip leg portion 64 may hang freely and be unattached to the side wall 54 and may thus allow the bumper guard 50 to be slightly deformed when contacted by a car door, allowing movement of the same when contacted by a car door.

Figure 5:
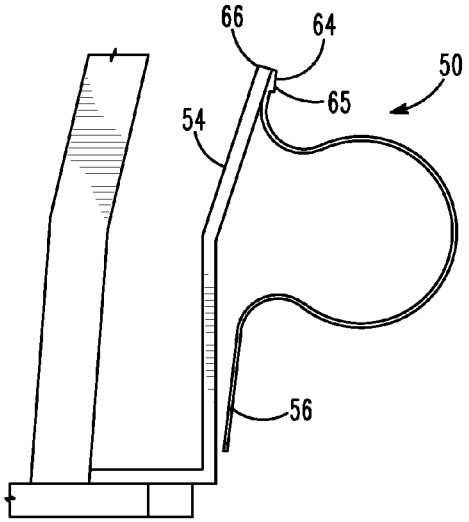
FIG. 5 illustrates a side view of a bumper guard clipped to a sidewall of an auto-rack railcar in an embodiment of the present invention.

FIG. 5 illustrates the bumper guard 50 in a clipped orientation on the side wall 54, such as typically contained on a roof rail on C-deck of an auto-rack railcar. Specifically, the side wall 54 may terminate at a termination point 66 and the clip leg portion 64 may be disposed at the termination point 66. In this configuration, therefore, the bumper guard 50 may be turned around so that the clip leg portion 64 is upwardly disposed and the flat leg portion 56 is downwardly disposed. A clip (not shown) may be placed over both the termination point 66 and the clip leg portion 64 of the bumper guard, holding the bumper guard 50 in place on the side wall roof rail 54. The clip leg portion may further have a nub or flange 65 thereon for holding a clip in place. Moreover, in this configuration, the flat leg portion 56 may be freely hanging and unattached to the side wall 54 so that the bumper guard 50 may be slightly deformed when contacted.

Because of the resiliency of the bumper guard 50, and the material it is made from, such as, preferably, thermoplastic material, the bumper guard 50 may easily retain its shape and "spring back" when deformed by contact with a car door. The bumper guard 50 may preferably be made from a material that is resilient to temperature extremes, such as extreme heat or extreme cold, and may function in either temperature, or in any other weather condition. Contact by a car door on the bumper guard 50 may prevent damage to the car door, as opposed to contact from a side wall or side post of the railcar. In a preferred embodiment, the thermoplastic may have additives, such as, preferably, calcium carbonate, for example, blended therein to add stiffness and aid in the extrusion process.

Figure 6:
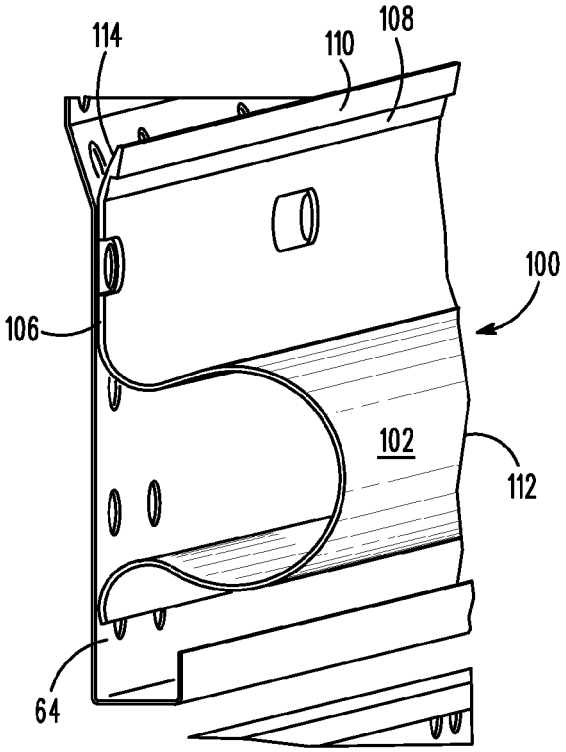
FIG. 6 illustrates a perspective view of a bumper guard on a sidewall of an auto-rack railcar in an alternate embodiment of the present invention.

FIG. 6 illustrates an alternate embodiment of the present invention of a bumper guard 100 attached to a side wall 104 having a C-shaped section 112 having a contacting surface 102 extending therefrom, similar to the bumper guard 50, disclosed above and shown in FIGS. 3-5. The bumper guard 100 may, however, have a flat leg portion 106 having a clip portion 114 disposed adjacent the flat leg portion 106, instead of on the other side of the C-shaped portion 112. The flat leg portion 106 may further have a plurality of holes or apertures 108 for aligning with holes 110 on the side wall 104 so that a bolt, clip or other connecting means (not shown) may be disposed therethrough, holding the bumper guard 100 to the side wall 104.

Figure 7:
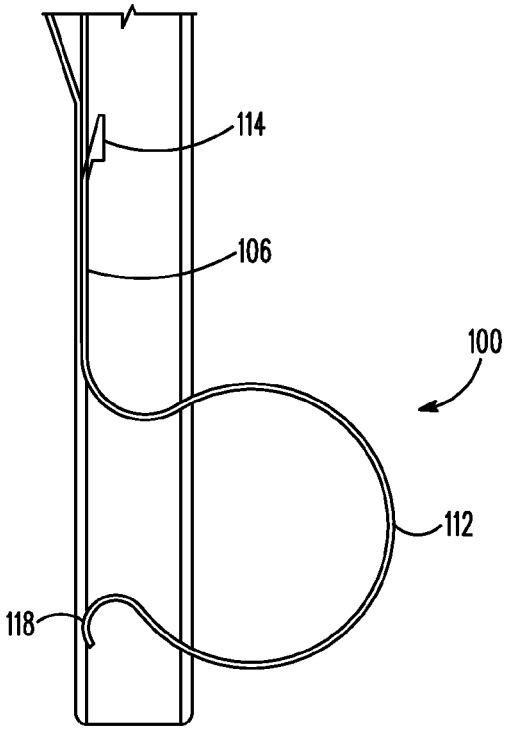
FIG. 7 illustrates a side view of a bumper guard on a sidewall of an auto-rack railcar in an alternate embodiment of the present invention.

The flat leg portion 106 and the clip portion 114 may be disposed on a first side of the C-shaped section 112. Disposed on the other side of the C-shaped section 112 may be a curved leg portion 118 which may freely hang and may remain unattached to the side wall 104. The curved portion 118 may move downwardly when C-shaped section 112 is contacted by a car door due to the spring action of the C-shaped section 112 without catching on any protruding parts of the side wall 104 when deforming due to contact with a car door. FIG. 7 illustrates the bumper guard 100 and the freely hanging curved portion 118 which may contact the side wall 104, especially when the bumper guard 100 is pressed or slightly deformed due to contact with a car door.

Figure 8:
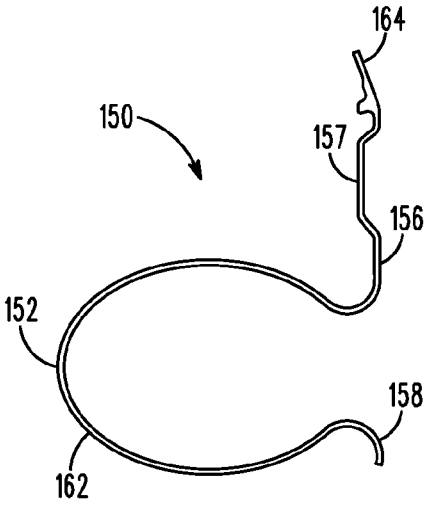
FIG. 8 illustrates side view of a bumper guard in an alternate embodiment of the present invention.

FIG. 8 illustrates an alternate embodiment of the present invention of a bumper guard 150, similar to the bumper guard 100 disclosed above and shown in FIGS. 6-7. Specifically, the bumper guard 150 may have a C-shaped section 162 having a contact surface 152 thereon. However, the C-shaped section may be more elliptically-shaped profile, especially when compared to the bumper guard 100, which may have a more circular profile shape, as shown in FIGS. 6-7. The C-shaped section may allow the contacting surface 152 to extend further relative to the bumper guard 100, described above, providing further protection to car doors when contacting the same. The elliptical design of the C-shaped section further stiffens the "spring action" of the C-shaped section when contacted by a car door, allowing less material to be utilized than a similar more circular C-shaped section, as described above.

The bumper guard 150 may further have a leg portion 156 extending from one side of the C-shaped section 162. The leg portion 156 may have a raised platform 157 that may be utilized to allow a bolt, clip or other fastening means to be disposed therethrough for attaching the same to a side wall (not shown). The raised platform may provide a tighter fit of the leg portion 156 with a bolt, clip or other fastening means.

Figure 10:
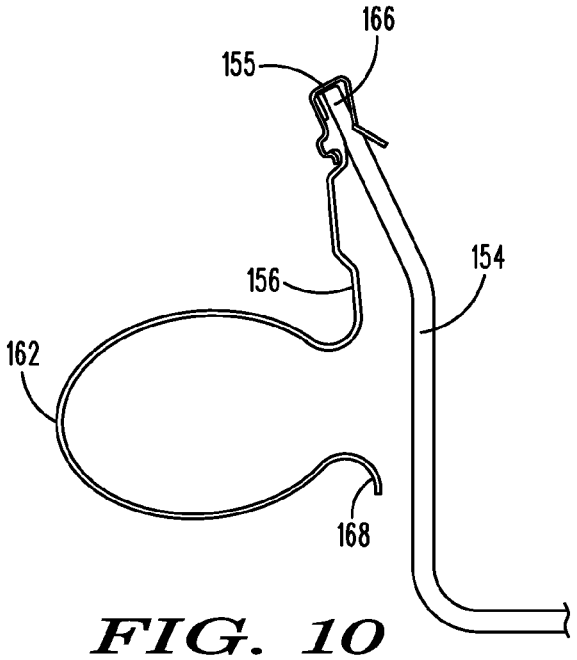
FIG. 10 illustrates a side view of a bumper guard clipped to a sidewall of an auto-rack railcar in an embodiment of the present invention.

A clip portion 164 may extend from the leg portion 156 to attach to a termination point 166 of a side wall 154, and may be clipped via a clip 155, as shown in FIG. 10. The clip 155 may hold the bumper guard 150 in place on the side wall 154, such as may be necessary on C deck, as described above.

Moreover, the bumper guard 150 may have a curved portion 168 extending from the second side of the C-shaped section, which may freely hang and remain unattached to the side wall 154, allowing for slight deformation of the bumper guard 150 when contacted by a car door.

Figure 9:
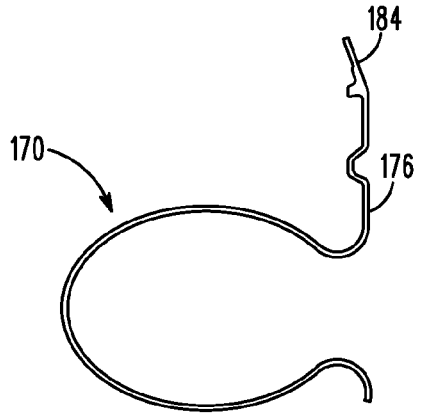
FIG. 9 illustrates a side view of a bumper guard in an alternate embodiment of the present invention.

FIG. 9 illustrates a bumper guard 170 in an embodiment of the present invention, similar to the bumper guard 150 but containing a leg portion 176 without holes or apertures therein for connecting to a side wall of an auto-rack railcar, and only allowing the same to be clipped to a termination point of a side wall (not shown) via clip portion 184.

Figure 11:
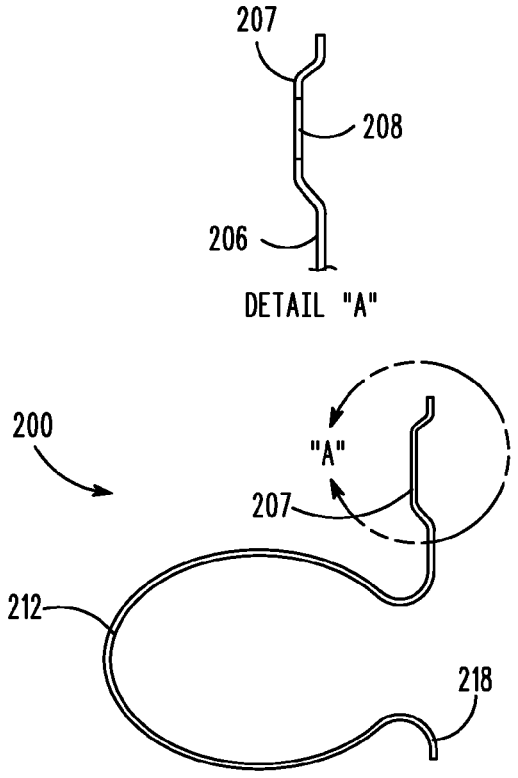
FIG. 11 illustrates a side view and a close-up view of a bumper guard in an alternate embodiment of the present invention.

In an alternate embodiment of the present invention, illustrated in FIG. 11, a bumper guard 200 is shown having a roughly elliptical C-shaped section 212 having a leg portion 206 extending therefrom having one or more holes or apertures 208 (as shown in detail A) for bolting, clipping or otherwise connecting to aligning holes of an auto-rack railcar. The bumper guard 200 may further have a curved section 218 that may freely hang and remain unattached to a sidewall, allowing the bumper guard to be deformed when contacted by a car door, but not catch on any protrusions on the side wall. The leg 206 may have a raised portion 207 for allowing a bolt, clip, button or other fastening means to be disposed therethrough for attaching the bumper guard 200 to a side wall. The raised portion 207 may allow for a tighter fit of the bolt, clip, button or other fastening means when the bumper guard 200 is fastened to a side wall.

Figure 12:
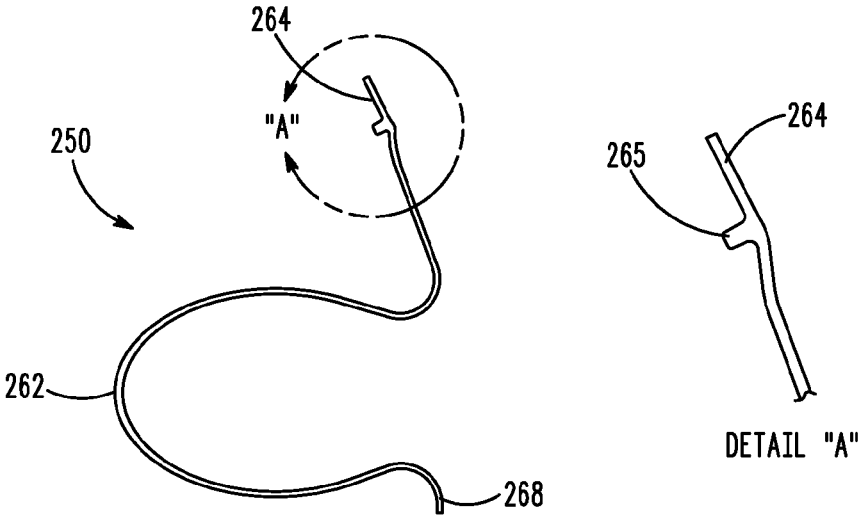
FIG. 12 illustrates a side view and a close-up view of a bumper guard in an alternate embodiment of the present invention.

FIG. 12 illustrates an alternate embodiment of the present invention of a bumper guard 250 having an elliptical C-shaped section 262 and an extended clip portion 264 extending from a first side of the C-shaped section 262 for attachment to a roof rail on C-deck. The extended clip portion 264 may angularly extend from the C-shaped section so that the extended clip portion 264 may be disposed adjacent a termination point of a roof rail (not shown) and clipped thereto via the extended clip portion 264. The C-shaped section may have, on its second side, a curved portion 268 that may freely hang and remain unattached to the roof rail. Detail A of FIG. 12 illustrates a close-up view of the clip portion 264 having a nub or flange 265 extending therefrom that may hold a clip (not shown) in place when clipped to a roof rail.

Figure 13:
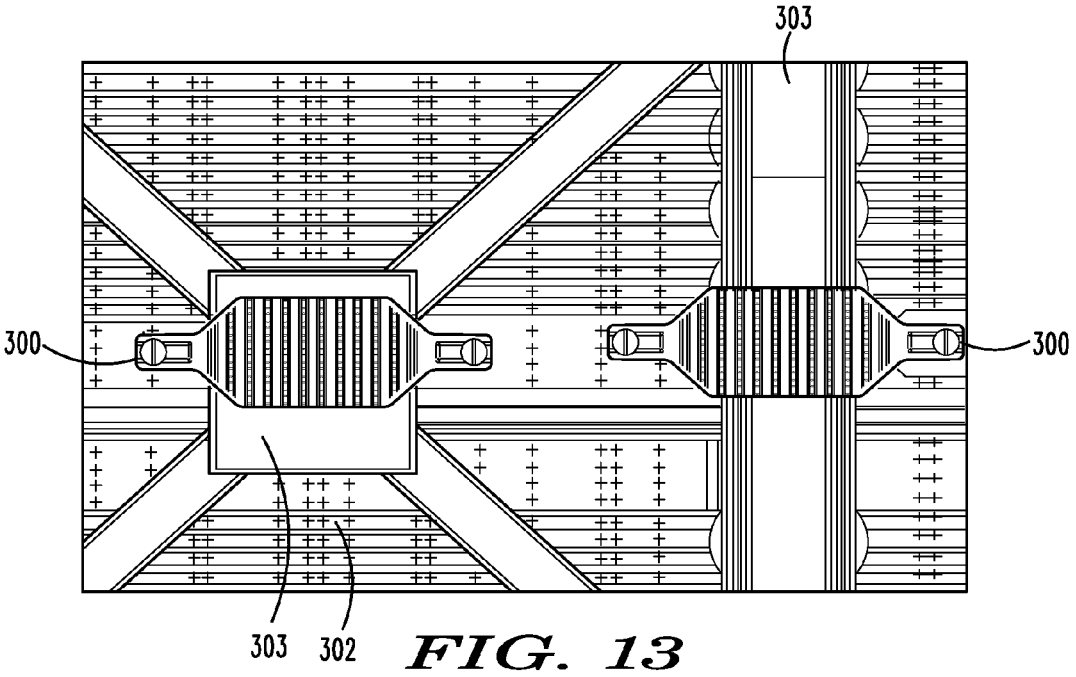
FIG. 13 illustrates a plurality of side post guards on a sidewall of an auto-rack railcar in an embodiment of the present invention.

FIG. 13 illustrates a plurality of side post guards 300 in an embodiment of the present invention. The side post guards 300 may be bolted, clipped or otherwise fastened or connected to the side wall or frame 302 of the railcar, and may wrap around side posts 303 or other protruding elements of the side wall 302 of the railcar, thereby protecting car doors that may contact the same when stored within the railcar.

Figure 14:
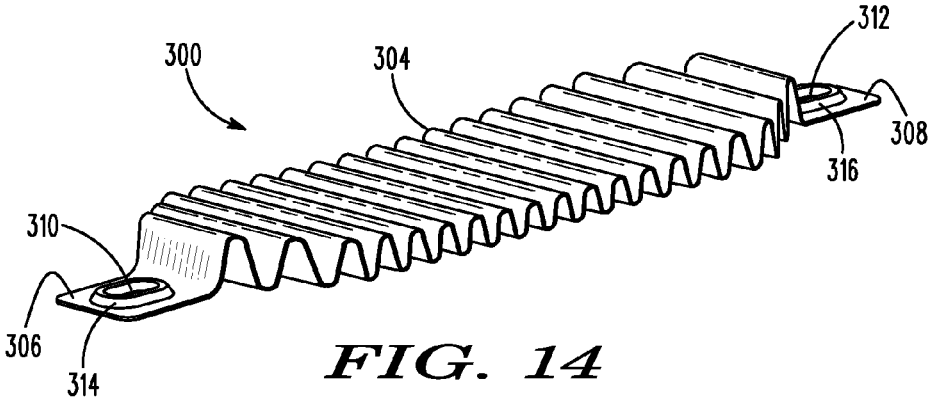
FIG. 14 illustrates a perspective view of a side post guard in an embodiment of the present invention.
Figure 15:
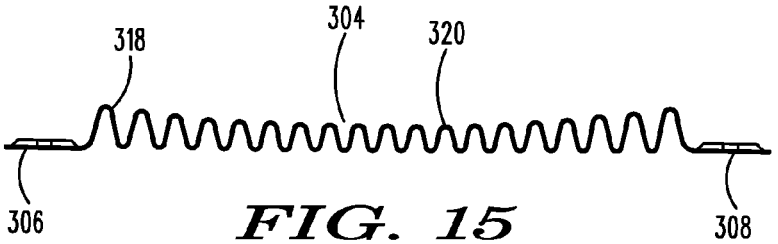
FIG. 15 illustrates a side view of a side post guard in an embodiment of the present invention.

FIG. 14 illustrates a perspective view of a side post guard 300 having an extended body portion 304 having an undulating shape in cross-section, as illustrated in FIG. 15. Wings 306, 308 may project from the sides of the body portion 304 having apertures 310, 312, respectively, disposed therein for placing a bolt, clip or other connecting means for connecting the side post guard 300 to a side wall of a railcar. The apertures may have protecting raised rings 314, 316 disposed therearound for allowing the bolts, clips or other connecting means to be disposed therein without risking contact with a car door.

As illustrated in FIG. 15, a side view of the side post guard 300, the undulating shape may have larger waves or undulations 318 toward an outside of the body portion 304 and smaller wavers or undulations 320 toward a middle of the body portion 304. For example, the waves or undulations may be progressively smaller when moving from an outside of the body portion 304 toward a middle of the body portion 304. Thus, the body portion may be more easily wrapped around side posts or the like, as illustrated in FIG. 16, due to the undulating design of the side post guard 300.

Figure 17:
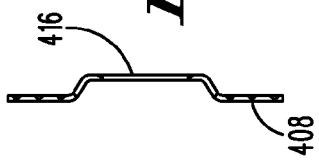
FIG. 17 illustrates a cross-sectional view of a side wing of a side post guard in an alternate embodiment of the present invention.
Figure 20:
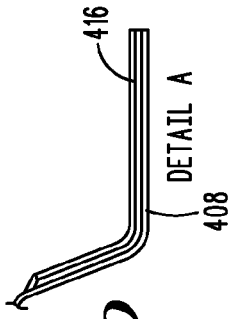
FIG. 20 illustrates a side view of a side wing of a side post guard in an alternate embodiment of the present invention.
Figure 16:
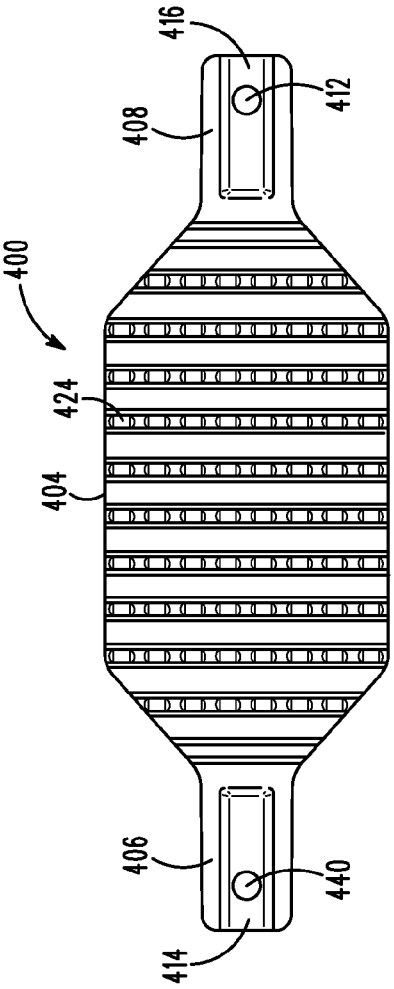
FIG. 16 illustrates a front view of a side post guard in an alternate embodiment of the present invention.
Figure 18:
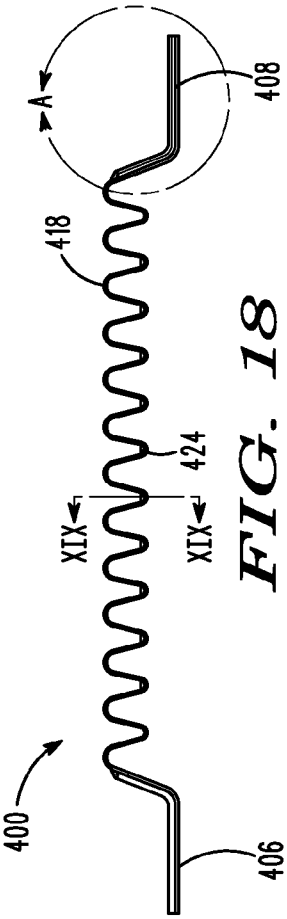
FIG. 18 illustrates a side view of a side post guard in an alternate embodiment of the present invention.
Figure 21:
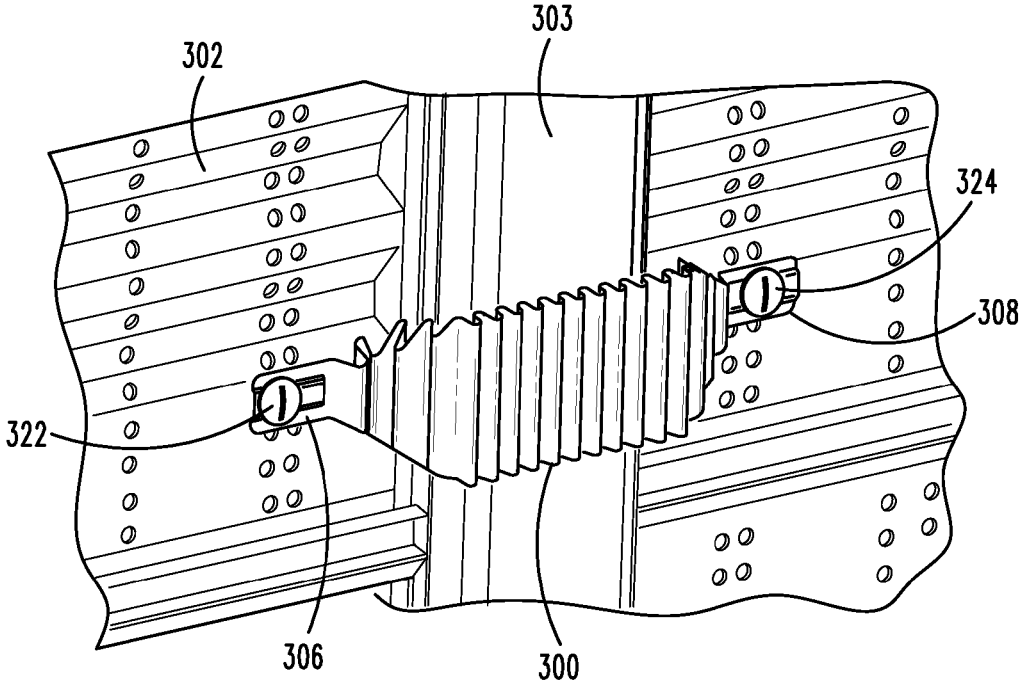
FIG. 21 illustrates a perspective view of a side post guard attached to a side wall of an auto-rack railcar in an embodiment of the present invention.

FIG. 16 illustrates a front view of an alternate side post guard 400 having an extended body portion 404 having an undulating shape as illustrated in FIG. 18, a bottom view of the side post guard 400. Wings 406, 408 may project from the sides of the body portion 404 having apertures 410, 412, respectively, disposed therein for placing a bolt, clip or other connecting means for connecting the side post guard 400 to a side wall of a railcar, as illustrated in FIG. 21. The apertures 410, 412 may have protecting raised ridges 414, 416 disposed on the wings 406, 408 (shown in cross-section along lines XVII-XVII in FIG. 17, and in side view in FIG. 20) for allowing the bolts, clips or other connecting means to be disposed therein without risking contact with a car door.

Figure 19:
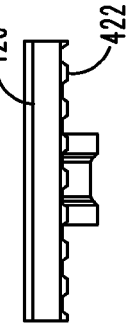
FIG. 19 illustrates a cross section vial view of a side post guard in an alternate embodiment of the present invention.

As illustrated in FIG. 17, a side view of the side post guard 400, the undulating shape may have consistently-sized waves or undulations 418 disposed from wing 406 to wing 408, as opposed to the larger waves or undulations 318 toward an outside of the body portion 304 and smaller wavers or undulations 320 toward a middle of the body portion 304 of side post guard 300, as shown in FIG. 15. Moreover, as illustrated in FIG. 19, which is a cross-section view along line XIX-XIX of the side post guard 400, in FIG. 18, the side post guard 400 may be made from a corrugated plastic, such as a plastic material having corrugations running on a bottom surface thereof. Specifically, plastic 420 may be extruded or thermoformed such that the corrugations 422 run from the top of the side post guard 400 to the bottom thereof.

Moreover, the side post guard 400 may have a plurality of ribs 424 disposed within each trough of each wave, as illustrated in FIGS. 16 and 18. Specifically, the plurality of ribs 424 may be disposed in various locations within each trough of each wave to provide strength and resiliency to the side post guard 400, and to further provide additional impact resistance should the edge of a vehicle door strike within the troughs of the waves of the side post guard 400. As shown in FIG. 18, the first trough 426 and the last trough 428 may be free from ribs so that these wave portions may have better flex, especially when disposed around railcar side posts, as shown in FIG. 21.

FIG. 21 illustrates side post guard 300 attached to side wall 302. It should be noted that while FIG. 21 shows side post guard 300 attached to side wall 302, side post guard 400, as illustrated in FIGS. 16-20, and disclosed in more detail above, may be attached to a side post on a railcar in a similar, if not identical, fashion. Bolts, buttons, clips or other connecting means 322, 324 attach wings 306, 308 to the side wall 302 and are disposed through the apertures 310, 312 in the wings 306, 308, respectively, and through holes in the side wall 302. The undulating shape of the side post guard 300 allows it to bend around a protruding side post 303 yet be connected to the side wall 302. The side post guard 300 may be strategically placed at a location where a car door of an automobile with an auto-rack railcar may contact the side post absent the side post guard 300. Indeed, the undulating design of the side post guard 300, as illustrated in FIGS. 13-16 may allow the side post guard 300 to expand as necessary to accommodate a wide variety of sizes and shapes of side post widths, cross-members, and other like structural features of an auto-rack railcar side wall or side frame.

As with the bumper guards, disclosed above and shown in FIGS. 2-12, the side post guards 300 and 400 may be made from a rigid thermoplastic material that may be easily deformable, especially when disposed around a side post, as shown in FIG. 21. In a preferred embodiment, the thermoplastic may have additives, such as, preferably, calcium carbonate, for example, blended therein to add stiffness and aid in the extrusion process. Thus, the side post guard 300 may protect a car door that may bump into the side post guard 300.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. A railcar sidewall bumper apparatus comprising:

an elongated body having an attachment flange portion and a rounded bumper portion, wherein the attachment flange portion extends from a first side to a second side of the elongated body and further has a top edge and a first transition portion, wherein the first transition portion transitions between the attachment flange and the rounded bumper portion, and further wherein the rounded bumper portion extends from the first side to the second side of the elongated body and, in cross-section, has a C-shape comprising a first leg, an outer curve and a second leg, and further wherein the first leg extends from the first transition portion of the attachment flange portion and further wherein the second leg comprises a second transition portion between the second leg and a bottom edge, wherein the bottom edge is configured to move vertically against a railcar sidewall in response to the rounded bumper portion impacted by an object.

2. The railcar sidewall bumper apparatus of claim 1 further comprising:

a plurality of apertures in the attachment flange portion for attaching the railcar sidewall bumper to a railcar sidewall.

3. The railcar sidewall bumper apparatus of claim 2 further comprising:

a raised portion around each of the plurality of apertures.

4. The railcar sidewall bumper apparatus of claim 2 wherein the plurality of apertures are oval slots.

5. The railcar sidewall bumper apparatus of claim 1 made from a material having a consistent thickness at all points in the sidewall bumper apparatus.

6. The railcar sidewall bumper apparatus of claim 1 wherein the bottom transition portion of the attachment flange portion is curved.

7. The railcar sidewall bumper apparatus of claim 1 wherein the first leg and the second leg are curved.

8. The railcar sidewall bumper apparatus of claim 1 wherein the top edge of the attachment flange portion has a clip element.

9. The railcar sidewall bumper apparatus of claim 8 wherein the clip element comprises a nub running from the first side to the second side of the railcar sidewall bumper apparatus.

10. The railcar sidewall bumper apparatus of claim 1 wherein the attachment flange portion extends upwardly from the first leg at roughly a ninety degree angle.

11. The railcar sidewall bumper apparatus of claim 1 wherein the second transition portion terminates at the bottom edge.

12. The railcar sidewall bumper apparatus of claim 1 further comprising:

an extended portion between the second transition portion and the bottom edge.

13. The railcar sidewall bumper apparatus of claim 11 wherein the extended portion between the second transition portion and the bottom edge has no apertures for attaching the extended portion to the railcar sidewall.

14. A railcar sidewall bumper system comprising:

a railcar sidewall bumper apparatus comprising an elongated body having an attachment flange portion and a rounded bumper portion, wherein the attachment flange portion extends from a first side to a second side of the elongated body and further has a top edge and a first transition portion, wherein the first transition portion transitions between the attachment flange portion and the rounded bumper portion, and further wherein the rounded bumper portion extends from the first side to the second side of the elongated body and, in cross-section, has a C-shape comprising a first leg, an outer curve and a second leg, and further wherein the first leg extends from the bottom transition portion of the attachment flange portion and further wherein the second leg comprises a second transition portion between the second leg and a bottom edge; and a railcar sidewall, wherein the attachment flange portion of the railcar sidewall bumper apparatus is attached to the railcar sidewall and further wherein the bottom edge is configured to move vertically against the railcar sidewall in response to the rounded bumper portion impacted by an object.

15. The railcar sidewall bumper system of claim 14 further comprising:

at least one apertures in the attachment flange portion of the railcar sidewall bumper apparatus; and at least one aperture in the railcar sidewall, wherein the aperture of the attachment flange portion is aligned with the aperture of the railcar sidewall; and a connection bolt disposed through the aperture in the attachment flange portion and the aperture in the railcar sidewall to hold the railcar sidewall bumper apparatus to the railcar sidewall.

16. The railcar sidewall bumper system of claim 15 further comprising:

a raised portion around the at least one aperture of the attachment flange portion.

17. The railcar sidewall bumper system of claim 15 wherein the at least one aperture in the attachment flange portion is an oval slot.

18. The railcar sidewall bumper system of claim 14 wherein the rounded bumper portion is made from a material having a consistent thickness at all points in the rounded bumper portion.

19. The railcar sidewall bumper system of claim 14 wherein the first transition portion of the attachment flange portion is curved.

20. The railcar sidewall bumper system of claim 14 wherein the first leg and the second leg are curved.

* * * * *